US005666098A

United States Patent [19]

Leupold

[11] Patent Number: 5,666,098

[45] Date of Patent: Sep. 9, 1997

[54] PERMANENT MAGNET TOROIDAL WIGGLER AND UNDULATOR

[75] Inventor: Herbert A. Leupold, Eatontown, N.J.

[73] Assignee: The United States of America as represented by the Secretary of the Army, Washington, D.C.

[21] Appl. No.: 653,785

[22] Filed: May 28, 1996

[51] Int. Cl.[6] ..... H01F 7/02

[52] U.S. Cl. ..... 335/306; 335/210; 315/5.34

[58] Field of Search ..... 335/210, 302–306; 315/5.34, 5.35, 502–504; 372/2, 21

[56] References Cited

U.S. PATENT DOCUMENTS 4,862,128 8/1989 Leupold ..... 335/306
5,317,228 5/1994 Leupold ..... 310/178

*Primary Examiner*—Michael L. Gellner
*Assistant Examiner*—Raymond M. Barrera
*Attorney, Agent, or Firm*—Michael Zelenka; William H. Anderson

[57] ABSTRACT

A permanent magnet toroidal structure having a periodic or modulated transverse magnetic field with an average magnetic field greater than zero providing containment for an electron beam. In one embodiment, permanent magnet toroidal sections having a magnetic orientation for producing a transverse magnetic field are spaced in a toroidal shape. A periodic or modulating magnetic field of a single direction is thereby formed. The magnetic field is stronger over the permanent magnet toroidal sections and the magnetic field is weaker, but of the same direction, in the spaces between the permanent magnet toroidal sections. The repetitive acceleration of electrons traversing the arc of the toroidal structure creates electromagnetic radiation. A core is placed within the cavity or working space of the toroidal structure. The core is made of either a permanent magnet material or a ferromagnetic material.

13 Claims, 3 Drawing Sheets

PERMANENT MAGNET TOROIDAL WIGGLER AND UNDULATOR

GOVERNMENT INTEREST

The invention described herein may be manufactured, used, imported, sold, and licensed by or for the government of the United States of America without the payment to me of any royalty thereon.

FIELD OF THE INVENTION

The present invention relates in general to permanent magnet structures used in electronic devices, and more particularly, to electromagnetic radiation sources.

BACKGROUND OF THE INVENTION

A typical electromagnetic radiation source using magnetic fields, such as a free electron laser, uses a series of permanent or electromagnet elements arranged axially with an axial cavity having a transverse magnetic field therein. The transverse magnetic field alternates in direction axially along the tube. Accordingly, an electron passing along the axial direction in the cavity is subject to a repetitive motion. This motion constitutes acceleration which will cause the electron to radiate electromagnetic radiation with a frequency depending on the period of the repetitive motion or the alternating magnetic field. One such magnetic structure that could be used to provide such an alternating magnetic field within a permanent magnet structure is disclosed in U.S. Pat. No. 4,862,128 entitled "Field Adjustable Transverse Flux Sources" issuing to Herbert A. Leupold on Aug. 29, 1989, which is herein incorporated by reference. When such a structure is formed to provide a magnetic field that is transverse to the axis and alternates with progression along the axis, an electron beam traveling along the longitudinal axis will oscillate in the direction normal to both the field and the longitudinal axis. A plane-polarized electromagnetic wave emanates from the accelerated electrons with the waves electric vector in the direction of the acceleration. By proper adjustment of the field strength and structural period, the various parts of the configuration can be made to radiate coherently. When this happens, the structure, which is generally referred to as a wiggler, is called an undulator and laser action occurs. However, in a linear structure, energy is extracted from an electron beam in the form of the desired electromagnetic radiation only during the time the electron beam transverses the spatially alternating magnetic field. The average magnetic field in such a magnetic structure is zero, because of the reversal between opposite polarities of equal strength.

While various magnetic structures have been designed to produce the desired forms of electromagnetic radiation, due to the limited time in which the electron beam transverses the spatially alternating magnetic field in a linear permanent magnet tube only a small portion of the kinetic energy of the electron is converted to electromagnetic radiation. Accordingly, there is a need for a permanent magnet structure that can adequately contain the electron beam in an effort to increase the power of the electromagnetic radiation thereby created.

SUMMARY OF THE INVENTION

The present invention comprises a plurality of permanent magnet sections arranged to form a toroidal shape having a cavity therein with a transverse magnetic field. The transverse magnetic field formed within the toroidal cavity has a uniform direction that is modulated so that the strength of the field varies periodically while progressing around the toroidal shape. In one embodiment, the magnetic field is modulated by spacing the toroidal sections. In another embodiment, the remanence of the permanent magnet toroidal sections is varied, creating the desired periodic or modulating structure. In another embodiment, the radius of the permanent magnet toroidal sections is varied to obtain the desired periodic or modulating transverse magnetic field. In another embodiment of the present invention, a core is placed in the toroidal cavity containing the transverse magnetic field. A slot in the plane of the toroid is made within the core to accommodate an electron beam. In one embodiment, the core is made of a permanent magnet. In another embodiment, the core is made from a passive ferromagnetic material, such as iron or an iron alloy.

Accordingly, it is an object of the present invention to confine an electron beam for generating electromagnetic radiation.

It is an advantage of the present invention that greater kinetic energy from the electrons in the electron beam is transferred to produce electromagnetic radiation.

It is a feature of the present invention that a modulated transverse magnetic field is created with a plurality of permanent magnet toroidal sections such that the transverse magnetic field does not reverse direction, or is able to contain an electron beam.

These and other objects, advantages, and features will become readily apparent in view of the following detailed description.

DETAILED DESCRIPTION OF THE PREFERRED EMBODIMENT

Figure 1:
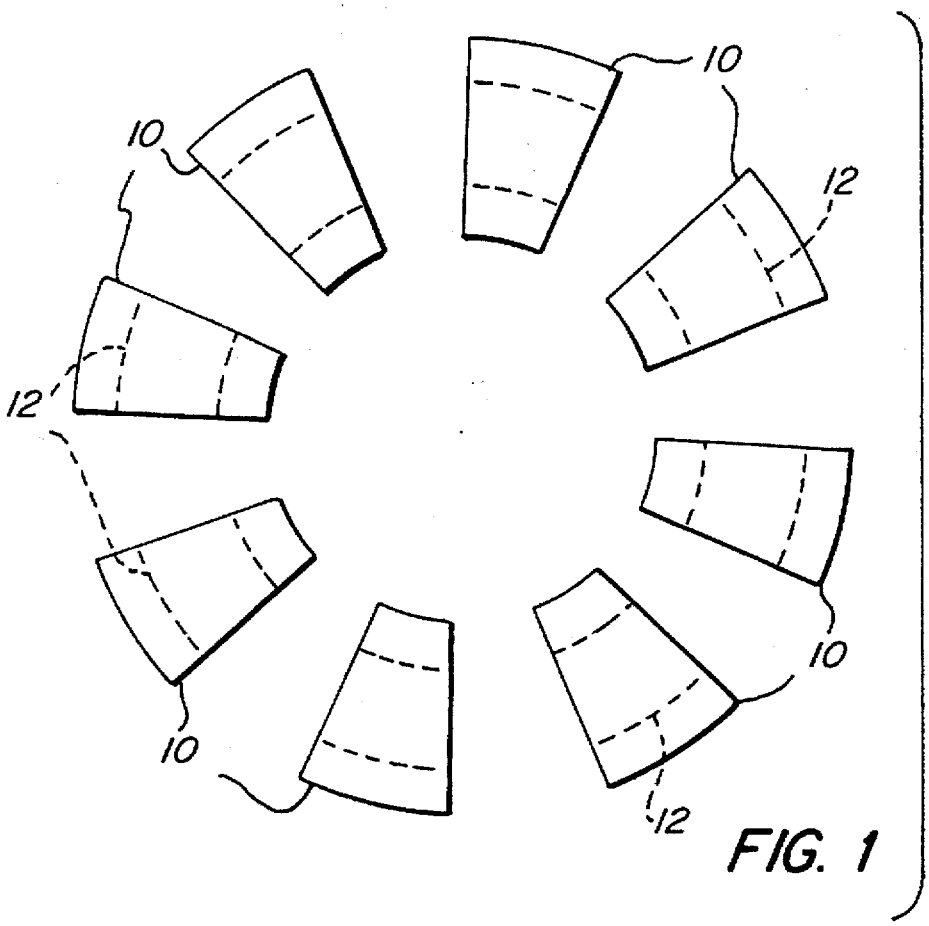
FIG. 1 is a schematic plan view illustrating one embodiment of the present invention.

FIG. 1 schematically illustrates one embodiment of the present invention. Permanent magnet toroidal segments 10 are positioned around a segmented core 12 forming a partial toroidal shape. Each segmented core 12 is disposed in each of the permanent magnet toroidal sections 10 (as shown by the dashed lines). The permanent magnet toroidal sections 10 have a magnetic orientation that forms a transverse magnetic field within a central cavity. Any suitable housing, not shown, may be used to hold the toroidal segments 10 in place.

Figure 2:
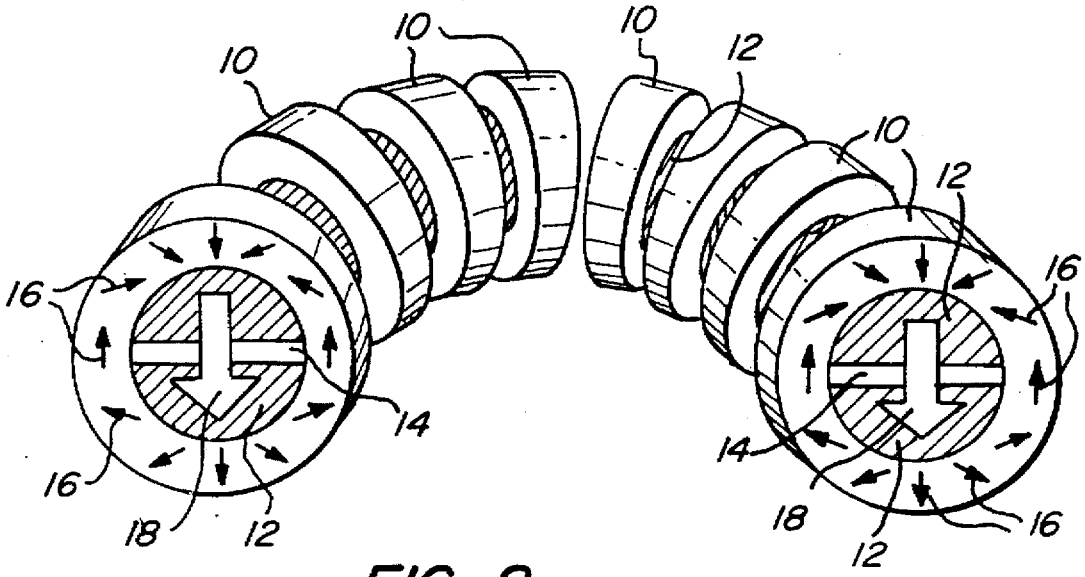
FIG. 2 is a partial perspective view illustrating the embodiment illustrated in FIG. 1.

FIG. 2 is a partial perspective cross section view of the embodiment illustrated in FIG. 1. In FIG. 2, the cavity or interior space of the toroidal magnetic structure can more clearly be seen. Permanent magnets 10 are toroidal sections having a cavity or interior space therein. The cavity or interior space is filled with a core 12. A slot 14 is formed in the principal equatorial plane of the core 12. Permanent magnet toroidal sections 10 have magnetization orientations which are illustrated by arrows 16. The head of the arrows represent magnetic north and the tail of the arrows represent magnetic south. This magnetic structure has often been referred to in the prior art as a "magic ring". This magnetic orientation creates a relatively strong transverse magnetic field within the cavity or interior working space illustrated by arrow 18. The core 12 may be made of a permanent magnet material oriented in the direction of the field created by the outer or cladding permanent magnet toroidal sections 10. The filler or core 12, when made from a permanent magnet material, provides an additional field given by:

$$\Delta H = B_R \left[ \sin T - \frac{T}{\Pi} - \frac{\sin T \cos T}{\Pi} \right]$$

where $B_R$ is the remanence of the core material; and

T is the angles subtended by the slot 14 at the center of the circular minor cross section of the toroid.

In the limit of a very narrow slot, where T approaches zero, then ΔH approaches $B_R$ divided by 2. This is a substantial addition to the field, in the order of $6K0_e$ for core material having a $B_R$ equal to 12, the highest commercially available. However, the present invention may be used without a core 12 or other filler material placed in the cavity or interior working space of the toroidal structure. Additionally, other core 12 materials may be used such as any soft or passive ferromagnetic material. If the magnetic field generated by the permanent magnet toroidal sections 10 exceeds one-half of the saturation magnetization of the soft or passive feromagnet material, the ferromagnetic material will add one-half its saturation magnetization to the magnetic field. For example, if the permanent magnet toroidal sections by themselves generate 11.0 kG, an ion insert of saturation magnetization $B_R$ equal to 20.0 kG will add 10.0 kG to 11.0 kG of the field created by the permanent magnet toroidal sections to yield a total field of 21.0 kG. This is a near doubling of the field at the expense of very little additional mass, bulk, or cost. In this way, a field sufficient to hold very energetic electrons in tight, circular orbits can be easily obtained. Such orbits entail large accelerations which in turn yield synchrotron radiation. Additionally, wiggler radiation can be obtained by azimuthal modulation of the passive ferromagnetic material.

Accordingly, an electron beam introduced into the slot 14 will be subjected to a magnetic field that contains the electron beam to a circle, without the need for any external magnetic structure. This is the result of the average field in the toroidal magnet structure not being zero as in prior magnet structures. In this embodiment of the present invention, in essence, every other permanent magnet toroidal segment is removed such that the remaining permanent magnet segments 10 have a transverse magnetic field in the same direction. Accordingly, the average field due to the remaining permanent magnet toroidal sections 10 form a magnetic constraint for retaining the electron beam to a circle. The magnetic field, however, will still oscillate along the arc of the circular electron path because a magnetic field in the gaps formed between the permanent magnet toroidal sections 10 is less than that formed at the center of the permanent magnet toroidal sections 10. As a result, a modulating or changing magnetic field is created that is also able to constrain electrons to a circular path.

Figure 3:
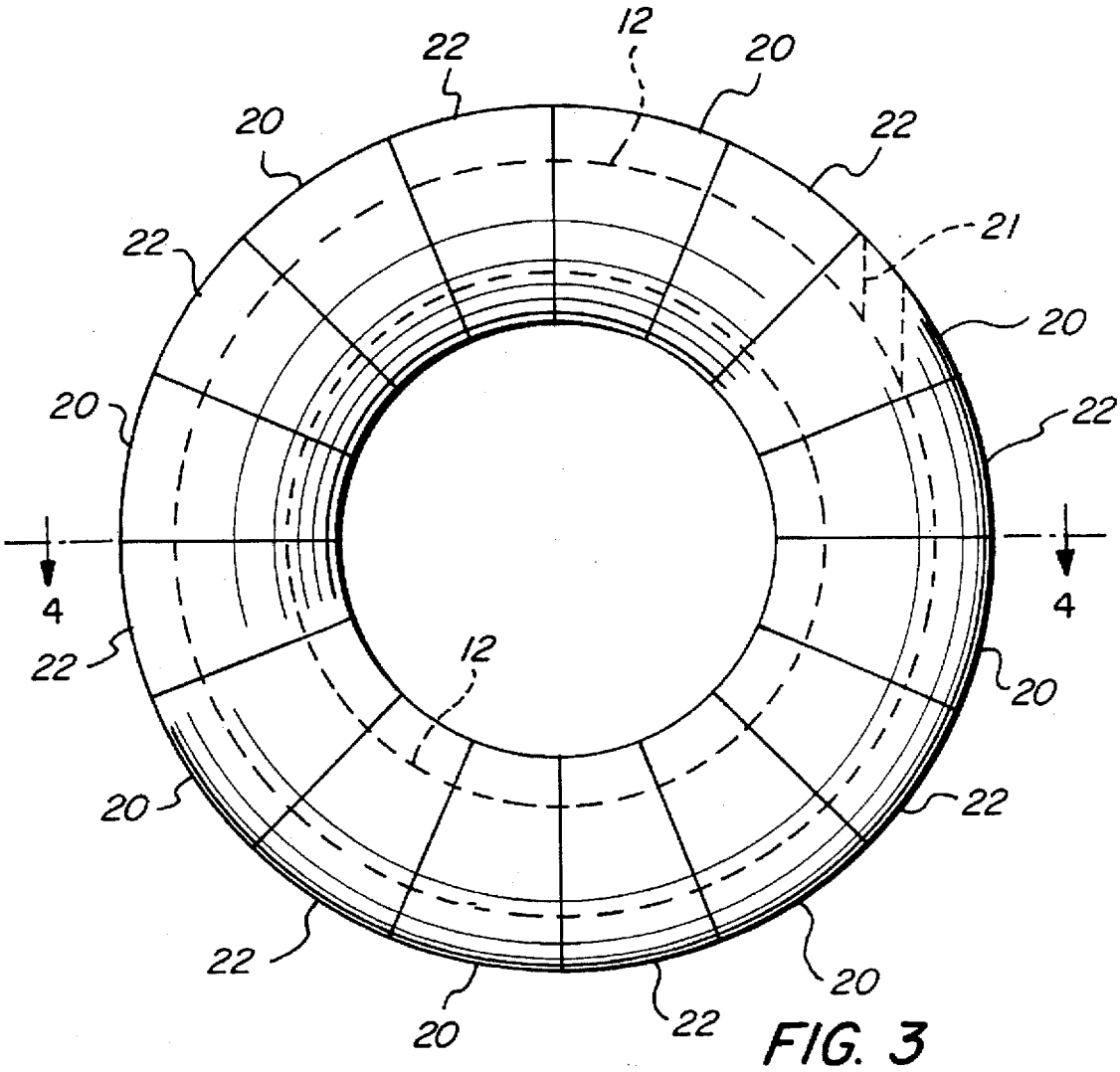
FIG. 3 is a schematic plan view illustrating another embodiment of the present invention.

Accordingly, the resulting permanent magnet toroidal structure can be modulated to give a transverse periodic magnetic field in many different ways. For example, FIG. 3 illustrates another embodiment of the present invention. Permanent magnet toroidal sections 20 have a high remnance. Permanent magnet toroidal sections 22 have a lower remnance. The difference in remanence between adjacent permanent magnet sections 20 and 22 creates a periodic or modulated transverse magnetic field. A hole 21 is formed in one of the toroidal segments 20 to permit an electron beam to enter the slot 14 in core 12.

Figure 4:
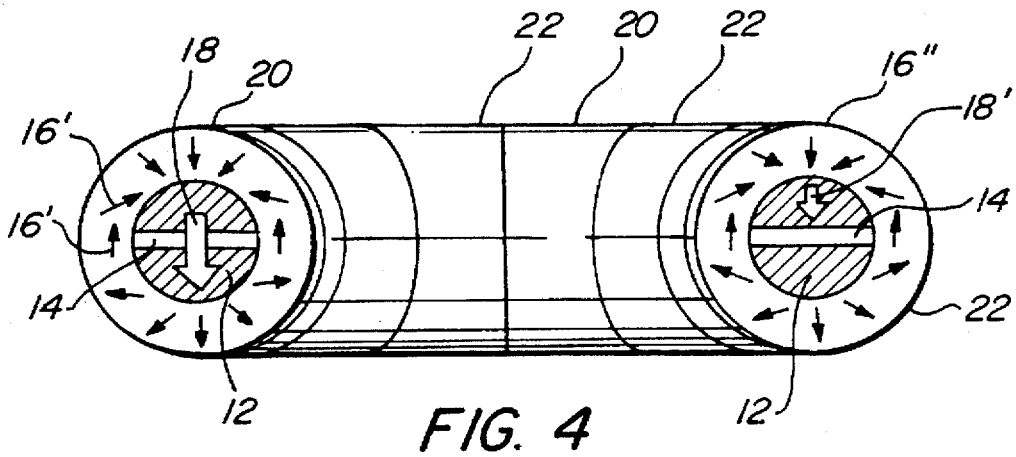
FIG. 4 is a cross section taken along line 4—4 in FIG. 3.

FIG. 4 is a cross section taken along line 4—4 in FIG. 3. FIG. 4 more clearly illustrates the effect of the different remanences associated with permanent magnet toroidal sections 20 and 22. On one end of the toroidal structure is permanent magnet toroidal section 20 being magnetized in the orientation shown by arrows 16' thereon. Arrows 16' represent the magnitude and direction of the magnetic orientation of the permanent magnet toroidal section 20. At the other end of the toroidal structure is illustrated permanent magnet toroidal section 22 being magnetized in the orientation shown by arrows 16" thereon. Arrows 16" illustrate the magnitude and direction of the magnetic orientation of permanent magnet toroidal section 22. Due to the higher remnance of the magnetic material used to create permanent magnet toroidal section 20, the magnitude of the magnetic orientation is greater, represented by the longer arrows 16'. The corresponding magnetic field created within the cavity or working space is illustrated by arrow 18. Arrows 16" associated with permanent magnetic toroidal section 22, represent the magnitude of the magnetic orientation as a result of the lower remnance of the material from which permanent magnet toroidal section 22 is made. Accordingly the arrows 16" are shorter than arrows 16'. As a result, the corresponding magnetic field represented by arrow 18' is not as strong. Accordingly, as illustrated in FIGS. 3 and 4, by varying the remnance of the permanent magnet material from which the permanent magnet toroidal sections 20 and 22 are made, a periodic or modulating toroidal structure is obtained. However, the outer diameter or circumference of the toroidal structure will be uniform. In some applications this may be advantageous. The ratio of the constant constraining field to the amplitude of the oscillating magnetic field can also be adjusted by alternating permanent magnet toroidal sections of materials with different remnance having either polarity or magnetic orientation so that the contribution of the permanent magnet toroidal sections to the constraining field can be positive, negative, or zero.

A wiggler formed in this way will also emit synchrotron radiation in addition to the oscillatory wiggler radiation. Additionally, it may be possible to combine the two modes effectively as their electric vector points in the same direction.

Figure 5:
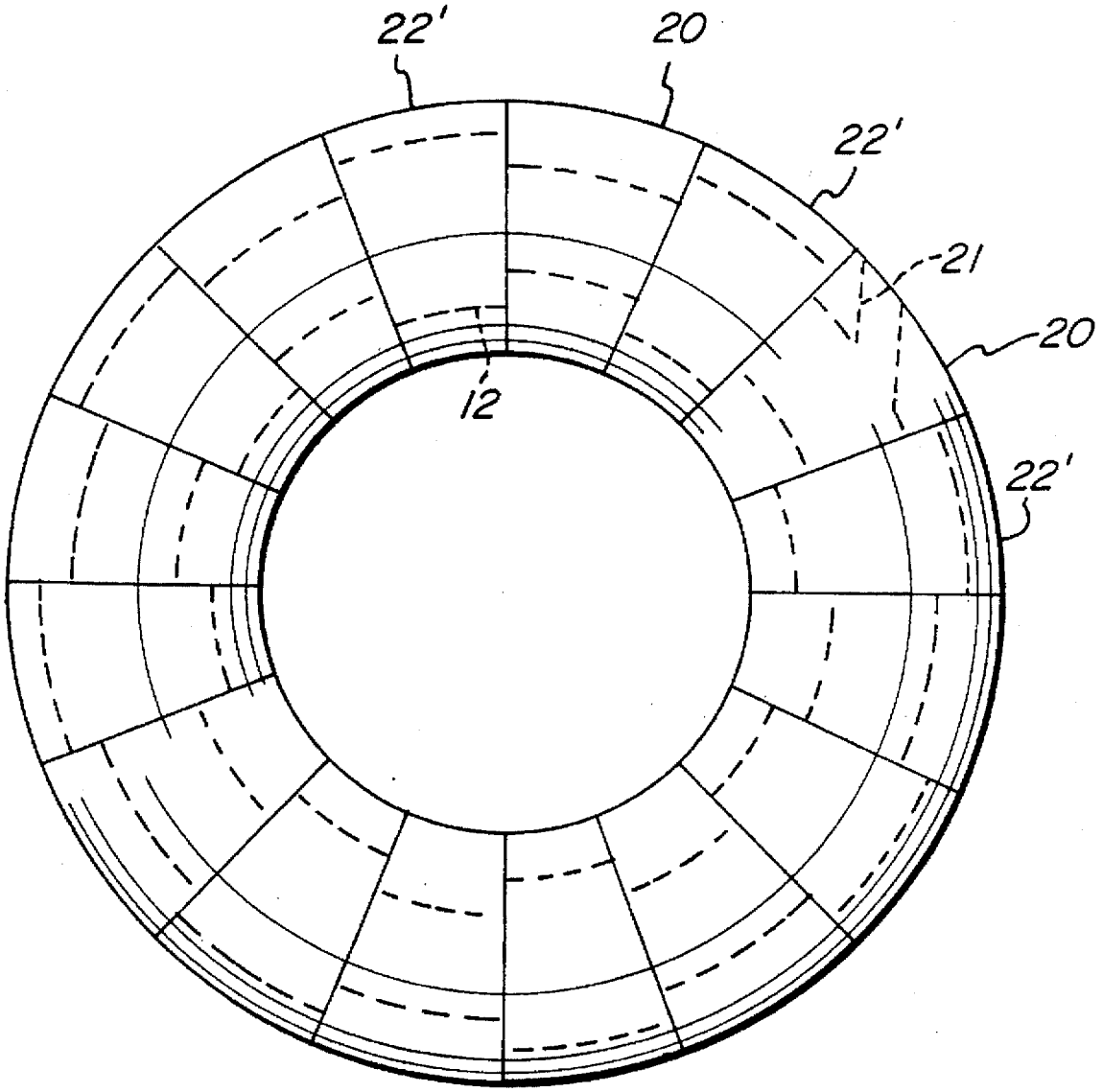
FIG. 5 is a schematic plan view illustrating another embodiment of the present invention.

FIG. 5 illustrates another embodiment of the present invention that uses permanent magnet toroidal segments 20 and 22', each having a different radial size or thickness. A hole 21 is formed in one of the toroidal segments 20 to permit an electron beam to enter a slot, similar to that illustrated in FIG. 4, formed in core 12. Accordingly, the cavity or interior working space within which core 12 is placed, will have a higher transverse magnetic field for the segments associated with permanent magnet toroidal sections 20 and a lower magnetic field for the segments associated with permanent magnetic toroidal sections 22'. As a result, a periodic or modulating transverse magnetic field is obtained progressing around the toroidal structure. There are numerous other additional ways in which the toroidal structure of the present invention may be modulated and still provide a containing magnetic field for the electron beam. For example, alternating portions of the core 12 can be omitted. The remnance of alternating portions of the core can be varied. Accordingly, various other alterations or combinations of the various alterations may be utilized to achieve the periodic or modulated magnetic field used to create acceleration in an electron in order to generate a desired electromagnetic radiation.

Accordingly, it should readily be appreciated that the present invention provides a periodic permanent magnet structure having a toroidal shape that has a resulting magnetic field able to contain an electron beam and thereby permit the electron to give up more of its kinetic energy to generate electromagnetic radiation. The present invention, therefore, has many applications directed, for example, to free electron lasers, wigglers, undulators, and many other electromagnetic radiation sources, the application of which will be readily apparent to those skilled in the art. Additionally, although the preferred embodiment has been illustrated and described, it will be obvious to those skilled in the art that various modifications may be made without departing from the spirit and scope of this invention.

What is claimed:

1. A toroidal permanent magnet structure comprising:

a plurality of permanent magnet toroidal sections, each of said plurality of permanent magnet toroidal sections having a magnetic orientation creating a substantially transverse magnetic field, said plurality of permanent magnet toroidal sections arranged in a toroidal shape creating a modulating transverse magnetic field and having an average magnetic field greater than zero; and a core wherein said plurality of permanent magnet toroidal sections are spaced around said core and wherein said core is made of a ferromagnetic material, whereby an electron beam capable of being introduced into the toroidal shape is contained and the repetitive motion of electrons in the electron beam generate electromagnetic radiation.

2. A toroidal permanent magnet structure comprising:

a plurality of permanent magnet toroidal sections, each said plurality of permanent magnet toroidal sections having a magnetic orientation creating a substantially transverse magnetic field, said plurality of permanent magnet toroidal sections arranged in a toroidal shape creating a modulating transverse magnetic field and having an average magnetic field greater than zero; and a core wherein said plurality of permanent magnet toroidal sections are spaced around said core and wherein said core is made of a permanent magnet material, whereby an electron beam capable of being introduced into the toroidal shape is contained and the repetitive motion of electrons in the electron beam generate electromagnetic radiation.

3. A toroidal permanent magnet structure as in claim 2 wherein:

said plurality of permanent magnet toroidal sections are spaced substantially evenly around said core.

4. A toroidal permanent magnet structure as in claim 2 wherein:

said core has a slot therein formed in a principal equatorial plane.

5. A toroidal permanent magnet structure for producing electromagnetic radiation comprising:

a plurality of toroidal permanent magnet sections, said plurality of toroidal permanent magnet sections combined to form a toroid having a cavity and a transverse modulating magnetic field formed within the cavity, said plurality of toroidal permanent magnet sections arranged to have a combined magnetic field capable of containing an electron beam within the cavity, wherein the transverse modulating magnetic field is created by said permanent magnet sections having a different magnetic remanence, and whereby electrons in the electron beam are capable of being repetitively accelerated generating electromagnetic radiation having a predetermined form.

6. A toroidal permanent magnet structure for producing electromagnetic radiation comprising:

a plurality of toroidal permanent magnet sections, said plurality of toroidal permanent magnet sections combined to form a toroid having a cavity and a transverse modulating magnetic field formed within the cavity, said plurality of toroidal permanent magnet sections arranged to have a combined magnetic field capable of containing an electron beam within the cavity, wherein the transverse modulating magnetic field is created by said permanent magnet sections having a different radial dimension, and whereby electrons in the electron beam are capable of being repetitively accelerated generating electromagnetic radiation having a predetermined form.

7. A toroidal permanent magnet structure for producing electromagnetic radiation as in claim 6 further comprising:

a core placed within the cavity.

8. A toroidal permanent magnet structure for producing electromagnetic radiation as in claim 7 wherein:

said core is made of a permanent magnet material.

9. A toroidal permanent magnet structure for producing electromagnetic radiation as in claim 7 wherein:

said core is made of a ferromagnetic material.

10. A toroidal permanent magnet structure for producing electromagnetic radiation as in claim 7 wherein:

said core has a slot therein formed in a principal equatorial plane.

11. A toroidal permanent magnet structure for producing electromagnetic radiation as in claim 9 wherein:

the transverse modulated magnetic field exceeds one-half of a saturation magnetization of the ferromagnetic material.

12. A toroidal permanent magnet structure for producing electromagnetic radiation comprising:

a plurality of toroidal permanent magnet sections, said plurality of toroidal permanent magnet sections combined to form a toroid having a cavity, said plurality of toroidal permanent magnet sections having a common magnetic orientation with varying magnetic field strengths causing a transverse modulating magnetic field to be formed within the cavity, one of said plurality of toroidal permanent magnet sections having a hole therein permitting an electron beam to enter the cavity;

a core placed in the cavity, said core having a slot therein formed in a principal equatorial plane, wherein said core is made of a permanent magnet material having a magnetic orientation in the same direction as the common magnetic orientation of said plurality of permanent magnet toroidal sections; and whereby electrons in the electron beam are capable of being contained within the slot of the cavity and repetitively accelerated by the transverse modulating magnetic field thereby resulting in the generation of electromagnetic radiation having a predetermined form dependent on the period of the transverse modulating magnetic field.

13. A toroidal permanent magnet structure for producing electromagnetic radiation comprising:

a plurality of toroidal permanent magnet sections, said plurality of toroidal permanent magnet sections combined to form a toroid having a cavity, said plurality of toroidal permanent magnet sections having a common magnetic orientation with varying magnetic field strengths causing a transverse modulating magnetic field to be formed within the cavity, one of said plurality of toroidal permanent magnet sections having a hole therein permitting an electron beam to enter the cavity;

a core placed in the cavity, said core having a slot therein formed in a principal equatorial plane, wherein said core is made of a ferromagnetic material; and whereby electrons in the electron beam are capable of being contained within the slot of the cavity and repetitively accelerated by the transverse modulating magnetic field thereby resulting in the generation of electromagnetic radiation having a predetermined form dependent on the period of the transverse modulating magnetic field.

* * * * *